US007069874B2

(12) United States Patent
Lavorata et al.

(10) Patent No.: US 7,069,874 B2
(45) Date of Patent: Jul. 4, 2006

(54) DAVIT-LAUNCHED LIFE RAFT

(75) Inventors: Marc Lavorata, Paris (FR); Pascal Michaud, Chevanceaux (FR)

(73) Assignee: Zodiac International, Issy les Moulineaux (FR)

( * ) Notice: Subject to any disclaimer, the term of this patent is extended or adjusted under 35 U.S.C. 154(b) by 28 days.

(21) Appl. No.: 10/966,586

(22) Filed: Oct. 15, 2004

(65) Prior Publication Data

US 2005/0112963 A1 May 26, 2005

(30) Foreign Application Priority Data

Oct. 16, 2003 (FR) ..... 03 12091

(51) Int. Cl.
*B63B 23/00* (2006.01)

(52) U.S. Cl. ..... 114/365; 441/40

(58) Field of Classification Search ..... 114/365, 114/366, 368, 369, 377; 441/35, 38, 40, 441/42

See application file for complete search history.

(56) References Cited

U.S. PATENT DOCUMENTS

| | | | | |
|---|---|---|---|---|
| 2,970,324 A | | 2/1961 | Phillips | |
| 3,222,700 A | * | 12/1965 | Smith | 441/38 |
| 4,364,326 A | * | 12/1982 | Pike | 114/369 |
| 4,406,244 A | * | 9/1983 | Buchan et al. | 114/368 |
| 5,791,281 A | | 8/1998 | Davidson | |

FOREIGN PATENT DOCUMENTS

| | | |
|---|---|---|
| GB | 2123353 | 2/1984 |
| WO | WO 97/30891 | 8/1997 |

* cited by examiner

*Primary Examiner*—Lars A. Olson
(74) *Attorney, Agent, or Firm*—Dean W. Russell; Kilpatrick Stockton LLP

(57) ABSTRACT

Life raft (1) launched by davit (7) and comprising for this purpose hanging means (4, 5) able to be held in a hook (6) suspended from the davit (7), this raft (1) being fitted out with equipment comprising at least one load ($\mathbf{10}_2$) that is heavy or heavier than the others, which raft is characterized in that the heavy or heavier load ($\mathbf{10}_2$) is attached to the aforesaid raft hanging means (4, 5), as a result of which, when the raft is hoisted by the davit, the heavy load or at least the heaviest load remains suspended from the raft hanging means without touching the raft, and the raft, being much better balanced, occupies a more horizontal position.

6 Claims, 1 Drawing Sheet

DAVIT-LAUNCHED LIFE RAFT

CROSS-REFERENCE TO RELATED APPLICATION

This application claims priority to French Patent Application No. 0312091 filed on Oct. 16, 2003, the contents of which are incorporated herein by reference.

1. Field of the Invention

The present invention relates to improvements to life rafts launched by davit and comprising for this purpose hanging means able to be held in a hook suspended from the davit, these rafts being fitted out with equipment comprising at least one load that is heavy or heavier than the others.

The invention is concerned more specifically, though not exclusively, with life rafts of inflatable type in particular, and of large capacity, (e.g. from 12 to 50 or even more persons) particularly as installed in passenger ships (cruise ships, car ferries, and the like).

2. Description of the Prior Art

The raft is usually provided with survival equipment (survival hardware, food, drinks etc.) which, in the case of complete equipment (the so-called "A pack"), includes in particular 1.5 litres of water and 1 kg of food per person. The raft inflating device is also heavy. For a large-capacity raft (able to hold several dozen people), this equipment is heavy.

The equipment of the raft is divided into several loads enclosed in watertight bags arranged on the floor of the raft around the air float.

Not only are these different loads not generally all the same weight, some being much heavier than others, but also they cannot be distributed symmetrically around the perimeter of the bottom of the raft because, among other things, when the raft is stored in its container, certain parts of the equipment are grouped together in bags to facilitate the folding of the raft.

In addition, a davit-launched raft generally comprises slings distributed peripherally around the inflatable float, with the free end of each attached to a hanging member such as a shackle that can be held by the davit hook. The raft is folded in the uninflated state for packing in the container. In most folding methods specific to davit-launched rafts, the terminal portions of the slings, with the shackle where they are brought together, pass out of the tent or canopy covering the raft through an opening at the top of the tent. Furthermore, during folding, the shackle is positioned at the front of the folded raft, above the bags containing the equipment, so that once the raft is packed in its container, the shackle can easily be reached by opening a hatch in the wall of the container.

To deploy the raft, after the container hatch has been opened the shackle is hooked onto the davit hook, the davit raises the container, swings it over the sea and sets it level with the deck. The inflation of the raft is then started with the aid of a percussion halyard provided for this purpose: the container opens and releases the complete raft which, being not yet inflated to full pressure, initially appears like a "cone" suspended from the shackle, before gradually assuming its shape as inflation proceeds. Finally the inflated raft is suspended from a single point (the shackle) situated approximately vertically above the centre of the raft.

However, the asymmetry described above in the distribution of the equipment loads means that, because it is hung from a single central point, the raft is very unbalanced and therefore hangs at a considerable angle.

To make the concept clearer, FIG. 1 of the appended drawing illustrates an example of a davit-launched inflatable-type life raft in position for passengers to enter it. The life raft 1 comprises, schematically, a float 2 consisting of two superposed inflatable tubes and a floor 3. Slings 4 attached to the float 2 are brought together at the top at hanging means which may advantageously be a shackle 5 in which the hook 6 of a launching davit 7 is engaged. The davit 7 may for example be situated on a deck 8 of a ship 9 and is used to position the raft, as indicated above, where the passengers can get into it (the arrow E indicates the entrance opening—not visible—of the raft).

Inside the raft 1 are a number of different loads in the form of watertight bags $\mathbf{10}_1$, $\mathbf{10}_2$, . . . containing equipment, at least one of these loads $\mathbf{10}_2$ being much heavier than the other loads $\mathbf{10}_1$, . . . . These loads rest on the floor 3 against the float 2, without being distributed symmetrically. What is more, the raft inflating equipment (gas bottles 11), which is attached to the outside underneath the floor 3, is also heavy. The exigences of accessibility to at least some bags of equipment and hardware, etc. discussed above mean that among other things the bag containing the heaviest load $\mathbf{10}_2$ and the gas bottles 11 are situated roughly on the same side of the raft, in the vicinity of the entrance E.

As a result, the raft 1, suspended from the davit 7, leans sharply towards the heaviest load $\mathbf{10}_2$ and the angle $\alpha$ it forms with the horizontal is noticeable, even large as visible in FIG. 1 (this angle may typically be as much as 30 to 40°). This angle means that the height h of the centre of the raft is higher than its lower edge.

This angle is too large and the weight of the raft with all its loads $\mathbf{10}_1$, $\mathbf{10}_2$, . . . is so great that attempts to at least partly right the raft manually by pulling it with a halyard are useless.

This imbalance of the raft suspended from the halyard creates several problems.

The passengers get into the raft when the raft, suspended over the sea under the davit, is level with the deck. If the raft is sloping as shown in FIG. 1, the sloping raft has to be raised higher than would otherwise be the case in order to position the entrance E (which is on the lowest side of the raft) level with the deck. This means that significantly more height is required underneath the davit than the minimum height that would be required if the raft were not inclined (the height of the deployed raft, the hook and the end of the launching cable). The davit must therefore be built in consequence, with increased height, but this greater height is problematic, possibly even incompatible with the installations of ships' decks, and in any case the resulting davit costs more.

Besides this, davits are usually pivoting, as illustrated in FIG. 1. To position the edge of the inclined empty raft in contact with the edge of the ship to allow the passengers to get in, the davit must first be pivoted inwards and then, once the raft has been made level by the first passengers getting in and sitting opposite the heaviest loads, pivoted outwards to keep the raft, which is now approximately horizontal, in contact with the edge of the deck. These manoeuvres are undesirable not simply because they complicate the boarding process (especially as the boarding area moves along the edge of the deck depending on where the raft is making contact with this edge, which in turn depends on the angular position of pivoting of the davit) but also and more importantly because they make the boarding process slower.

It should also be emphasized that these difficulties of manoeuvring the raft with the aid of the davit are considerably amplified if the ship has been damaged (according to SOLAS Rules, the use of davit-launched rafts must be possible when the ship has a list of 10° to one side or the other and/or a trim of 20° fore or aft).

Also, if the initial angle of the raft is not compensated for by the davit raising the raft, the edge of the raft containing the entrance E is situated someway below the ship's deck. The first people then have to jump from the ship into the raft, a difficult, not to say perilous exercise with a choppy sea and/or a violent wind. Once again, the boarding operation is slowed down.

Lastly, the series of operations required to raise the inclined empty raft to get it level with the edge of the ship's deck, and afterwards to lower it once it is balanced by the first people having got inside it, requires the crew to know what manoeuvres are going on and demands special training.

To conclude, it should be emphasized that the current tendency is to fit ships out with rafts of ever larger capacity to compensate for the numerical reductions in crew sizes (each raft put into the water has to have at least one crew member in command of it). This increased raft capacity has led to large dimensions and increased equipment loads (especially of survival rations) arranged around the edge of the raft, causing the tilting torque of such rafts when suspended from a single central point to be greater and its inclination when empty to become very considerable. This makes the difficulties described above even more critical.

SUMMARY OF THE INVENTION

It is an object of the invention to provide a novel solution that will eliminate at least the greater part of the disadvantages described above encountered with current life raft designs and that will enable a raft hoisted by a davit to occupy a much more horizontal position.

To these ends, the life raft as described in the preamble is characterized, when fitted out in accordance with the invention, in that the heavy load or at least the heaviest load of the equipment is attached to said raft hanging means.

In this way, the heavy load or at least the heaviest load is physically detached from the raft with which it is no longer in contact once the raft is inflated and suspended from the davit, so that the raft is much better balanced and can occupy a much more horizontal position. Being suspended from the raft hanging means, this heavy load or the heaviest load nonetheless remains above the raft during the manoeuvres and drops back into it once the raft is in the water and released from the davit hook.

The solution put forward in accordance with the invention therefore makes it possible to keep the raft in a correct situation, leading to a rapid boarding process and does not have special requirements in terms of hardware, particularly davits. Nor does it require any additional work by the crew members, or an additional training of them.

Where the equipment is distributed in several heavy loads, some of which are much heavier than the others, the heaviest loads are attached to the raft hanging means.

In practice, the raft hanging means generally include several slings brought together at a shackle that can be held by a hook suspended from the davit and the heaviest load or loads are attached to the shackle.

The provisions of the invention are particularly useful in their application to life rafts of large, even very large capacity which are more sensitive to unbalanced loads when hanging from the launching davit, and the invention is consequently of particularly useful application to inflatable life rafts.

BRIEF DESCRIPTION OF THE DRAWING

A clearer understanding of the invention will be gained on reading the following detailed description of a preferred embodiment presented by way of example only, for purely illustrative purposes, shown in FIG. 2 of the appended drawing.

DETAILED DESCRIPTION OF THE INVENTION

Figure 1:
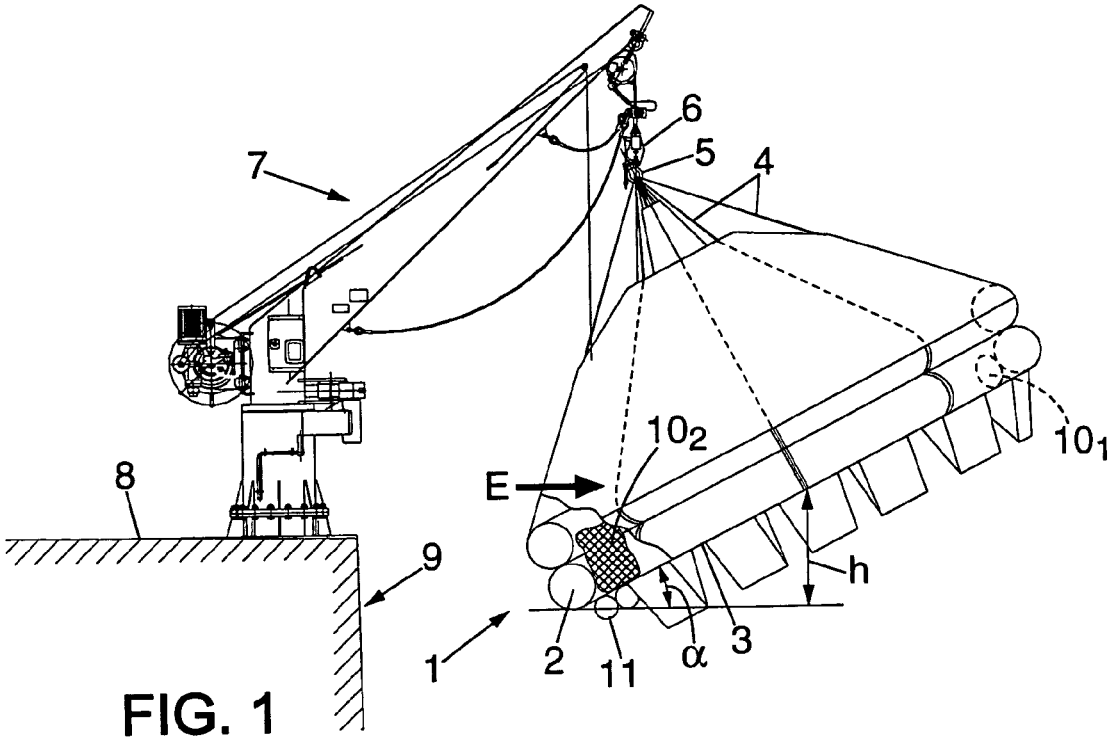
Figure 2:
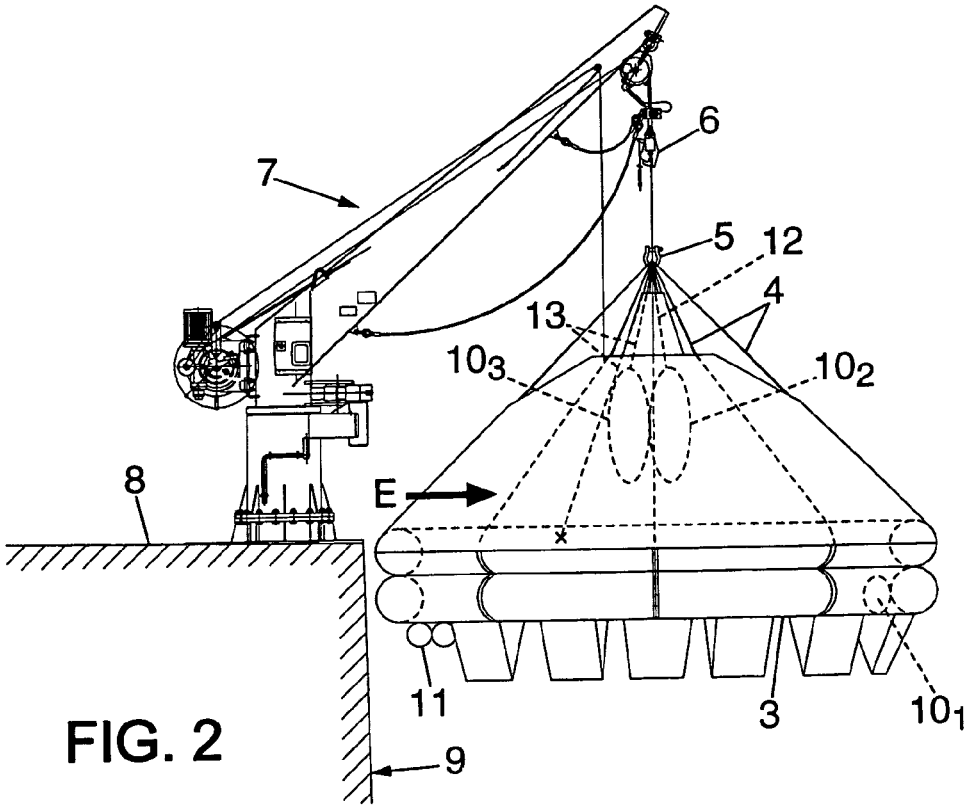

FIG. 2 repeats the illustration given in FIG. 1 except that the heaviest load $\mathbf{10}_2$ is no longer attached to the inside of the raft but is secured to hanging means depicted by the shackle 5 so that when the raft is suspended, the heaviest load $\mathbf{10}_2$ is suspended from the shackle 5 above the raft without touching the raft. The load $\mathbf{10}_2$ may be attached to the shackle 5 either directly or, as illustrated in FIG. 2, via a strap 12 hung from the shackle 5. In this way the load $\mathbf{10}_2$ no longer influences the position of the raft 1.

For example, in the typical example of a raft with a 37-person capacity, its total empty weight is about 240 kg (without the container); the survival rations (1.5 l of water and 0.5 kg of food per person) weigh a total of 74 kg, which is approximately 30% of the raft's mass. The bag or bag containing these rations, being suspended from the shackle, no longer contribute to the imbalance of the empty raft.

As illustrated in FIG. 2, the more balanced raft occupies a position closer to the horizontal, the residual tilt resulting from the non-symmetrical distribution of the other loads or masses, in particular the inflation bottle or bottles 11. It thus becomes possible to greatly reduce the residual tilt of the raft, which may be for example typically about a maximum of 16°. Raft deployment is therefore greatly improved because the movements of the davit are limited to those strictly necessary; the first person gets into the raft in non-perilous conditions even if the raft is at a slight angle and this person alone is sufficient to level the raft again. Furthermore, if necessary, the raft, being much lighter, can be pulled and held against the edge of the deck with a halyard to help people get on board, in particular when the sea is choppy. This avoids the complications of manoeuvres necessitated by having a raft at a steep angle and enables the people to get into the raft quickly, but still allows davits of minimal height to be used.

If the equipment of the raft is distributed in the form of loads, several of which are significantly heavier than the others, these heavier loads are all hung on the shackle 5 (as illustrated by the load $\mathbf{10}_3$ hung on the shackle 5).

As a variant, the load $\mathbf{10}_3$ is shown suspended from the shackle 5 by means of a strap 13 which passes through the free-sliding shackle and is attached to the raft, for example at a point on a float, so that when the strap is set at the appropriate length, the load $\mathbf{10}_3$ is automatically raised above the raft when the raft is inflated.

The provisions of the invention remove the problems discussed in the preamble, yet without any great complication or significant additional cost to the raft thus equipped. Moreover, with an arrangement in accordance with the invention, the raft folding procedure, by which it is packed into the container, is very little changed from that practised hitherto, the equipment loads still being kept close to the hatch provided in the wall of the container to allow access to the shackle that goes on the davit hook.

What is claimed is:

1. Life raft adapted to be launched by davit and comprising for this purpose hanging means able to be held in a hook suspended from the davit, this raft being fitted out with equipment comprising one heavy load or several loads among which at least one is heavier, wherein the heavy or heavier load is attached to the raft hanging means, whereby, when the raft is hoisted by the davit, the heavy or heavier load remains suspended from the raft hanging means without touching the raft, and the raft, being much better balanced, occupies a more horizontal position.

2. Raft according to claim 1, wherein the equipment is distributed in several heavy loads, some of which are substantially heavier than remaining loads, and in that the heavier loads are attached to the raft hanging means.

3. Raft according to claim 1 or claim 2, wherein the raft hanging means include several slings brought together at a shackle and in that the heavy load or heavier loads are attached to the shackle.

4. Raft according to claim 1 or claim 2, wherein the heavy load or heavier loads are each suspended from the raft hanging means by a strap suspending from coupled to the raft hanging means.

5. Raft according to claim 1 or claim 2, wherein the heavy load or heavier loads are each suspended from the raft hanging means by a strap which extends and slides through the raft hanging means and which is fixed to the raft.

6. Raft according to claim 1, wherein the raft is an inflatable raft.

* * * * *